US009809959B2

(12) United States Patent
Graham et al.

(10) Patent No.: US 9,809,959 B2
(45) Date of Patent: Nov. 7, 2017

(54) RETENTION SYSTEM HAVING DOUBLE-ENDED EXPANDABLE PIN

(71) Applicant: Caterpillar Inc., Peoria, IL (US)

(72) Inventors: Susan Marie Graham, Morton, IL (US); Stephen John Pierz, Peoria, IL (US); Ronald Mark Ginn, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 105 days.

(21) Appl. No.: 14/878,273

(22) Filed: Oct. 8, 2015

(65) Prior Publication Data

US 2016/0115674 A1 Apr. 28, 2016

Related U.S. Application Data

(60) Provisional application No. 62/067,710, filed on Oct. 23, 2014.

(51) Int. Cl.
*E02F 9/28* (2006.01)

(52) U.S. Cl.
CPC ..... *E02F 9/2833* (2013.01); *E02F 9/2891* (2013.01)

(58) Field of Classification Search
CPC ..... E02F 9/2833; E02F 9/2841; E02F 9/2875; E02F 9/92883; E02F 9/2891
USPC ..... 411/55, 57.1, 58, 60.2
See application file for complete search history.

(56) References Cited

U.S. PATENT DOCUMENTS 1,349,437 A * 8/1920 Royer ..... F16B 13/068 411/24
1,780,397 A 11/1930 McKee et al.
2,760,399 A * 8/1956 Rea ..... F16B 13/00 29/509
3,022,586 A 2/1962 Towne
3,060,761 A 10/1962 Barkley
3,742,809 A * 7/1973 Zifferer ..... F16B 13/124 411/61
3,848,506 A * 11/1974 Zifferer ..... F16B 13/124 411/17
4,067,657 A * 1/1978 Kaarlela ..... E02F 9/2841 37/456
4,083,162 A 4/1978 Regan et al.
4,408,937 A * 10/1983 Hainke ..... F16B 13/06 411/42

(Continued)

FOREIGN PATENT DOCUMENTS

WO WO 2014/031647 2/2014

OTHER PUBLICATIONS http://bellcancorp.com/anchors/double-expansion/, "Double Expansion" pp. 1-4, printed Oct. 7, 2015.

*Primary Examiner* — Matthew D Troutman

(74) *Attorney, Agent, or Firm* — Finnegan, Henderson, Farabow, Garrett & Dunner LLP

(57) ABSTRACT

A retention system is provided for use in connecting a replaceable tool to a work implement. The retention system may have a generally cylindrical pin with a first hollow end, and a second hollow end located opposite the first hollow end. The retention system may also have a first fastener configured to engage the first hollow end and cause the first hollow end to flare radially outward. The retention system may further have a second fastener configured to engage the second hollow end and cause the second hollow end to flare radially outward.

3 Claims, 3 Drawing Sheets

(56) References Cited

U.S. PATENT DOCUMENTS

| | | | | |
|---|---|---|---|---|
| 5,169,269 | A * | 12/1992 | Tatematsu | F16B 13/068 403/297 |
| 6,092,958 | A | 7/2000 | Gale | |
| 8,267,628 | B2 | 9/2012 | Noce et al. | |
| 8,511,035 | B2 | 8/2013 | Zimmer et al. | |
| 8,657,543 | B2 | 2/2014 | Fabre et al. | |
| 8,678,730 | B2 | 3/2014 | Gaudron et al. | |
| 9,187,881 | B2 * | 11/2015 | Bierwith | B23P 19/04 |
| 2005/0274047 | A1 * | 12/2005 | Pippins | E02F 9/2841 37/455 |
| 2010/0162595 | A1 | 7/2010 | Leslie et al. | |
| 2014/0010613 | A1 | 1/2014 | Gaudron et al. | |
| 2014/0072384 | A1 | 3/2014 | Wissling | |
| 2014/0161556 | A1 | 6/2014 | Toosky et al. | |
| 2015/0082671 | A1 * | 3/2015 | Bierwith | B23P 19/04 37/455 |

* cited by examiner

RETENTION SYSTEM HAVING DOUBLE-ENDED EXPANDABLE PIN

RELATED APPLICATIONS

This application is based on and claims priority to U.S. Provisional Application No. 62/067,710 filed on Oct. 23, 2014, the contents of which are expressly incorporated herein by reference.

TECHNICAL FIELD

The present disclosure relates generally to a retention system and, more particularly, to a tool retention system having a double-ended expandable pin.

BACKGROUND

Earth-working machines, such as cable shovels, excavators, wheel loaders, and front shovels, include implements generally used for digging into, ripping, or otherwise moving earthen material. These implements are subjected to extreme abrasion, and impacts that cause them to wear. To prolong the useful life of the implements, various ground engaging tools can be connected to the earth-working implements at areas experiencing the most wear. These ground engaging tools are replaceably connected to the implements using a retention system.

An exemplary system for retaining a ground engaging tool connected to an implement is disclosed in U.S. Patent Publication No. 2010/0162,595 of Leslie et al. that published on Jul. 1, 2010 ("the '595 publication"). Specifically, the '595 publication discloses a retaining pin assembly for an excavator tooth. The retaining pin assembly has opposing ends, each with a shank portion inserted into apertures on opposing sides of a wear member. The ends of the retaining pin assembly also have an enlarged asymmetrical tapered wedge portion. When tension is applied to the ends of the retaining pin assembly, relative contraction occurs to urge the wear member into further engagement with a mounting nose.

Although acceptable for some applications, the retaining pin assembly of the '595 publication may be less than optimal. In particular, the assembly may be complex, expensive, and lack durability required for some conditions. Further, the asymmetric nature of the retaining pin assembly may require corresponding asymmetric openings in the wear member and the mounting nose. These openings may be difficult to produce, require precise alignment during assembly, and increase a cost of the components.

The disclosed tool retention system is directed to overcoming one or more of the problems set forth above.

SUMMARY

According to one exemplary aspect, the present disclosure is directed to a retention system for use in connecting a replaceable tool to a work implement. The retention system may include a generally cylindrical pin with a first hollow end and a second hollow end located opposite the first hollow end. The retention system may also include a first fastener configured to engage the first hollow end and cause the first hollow end to flare radially outward. The retention system may further include a second fastener configured to engage the second hollow end and cause the second hollow end to flare radially outward.

According to another exemplary aspect, the present disclosure is directed another retention system for use in connecting a replaceable tool to a work implement. This retention system may include a pin having a first end with a plurality of axially extending fingers, and a tapered fastener configured to engage the axially extending fingers at the first end.

According to yet another exemplary aspect, the present disclosure is directed to a tool assembly. The tool assembly may include a work implement base having a protruding nose portion and a bore passing transversely through the protruding nose potion. The tool assembly may also include a replaceable tool received over the protruding nose portion of the work implement base and having apertures at opposing sides that are generally aligned with each other and with the bore of the work implement base. The tool assembly may further include a pin extending through the apertures of the replaceable tool and the bore of the work implement base, and having a plurality of axially extending fingers located at each of two opposing ends. The tool assembly may additionally have a first tapered fastener engaged with the axially extending fingers at a first of the two opposing ends, and a second tapered fastener engaged with the axially extending fingers at a second of the two opposing ends. Engagement of the first and second tapered fasteners with the axially extending fingers may cause the axially extending fingers to flare radially outward and engage the work implement. Heads of the first and second tapered fasteners may engage walls of the apertures in the replaceable tool.

DETAILED DESCRIPTION

Figure 1:
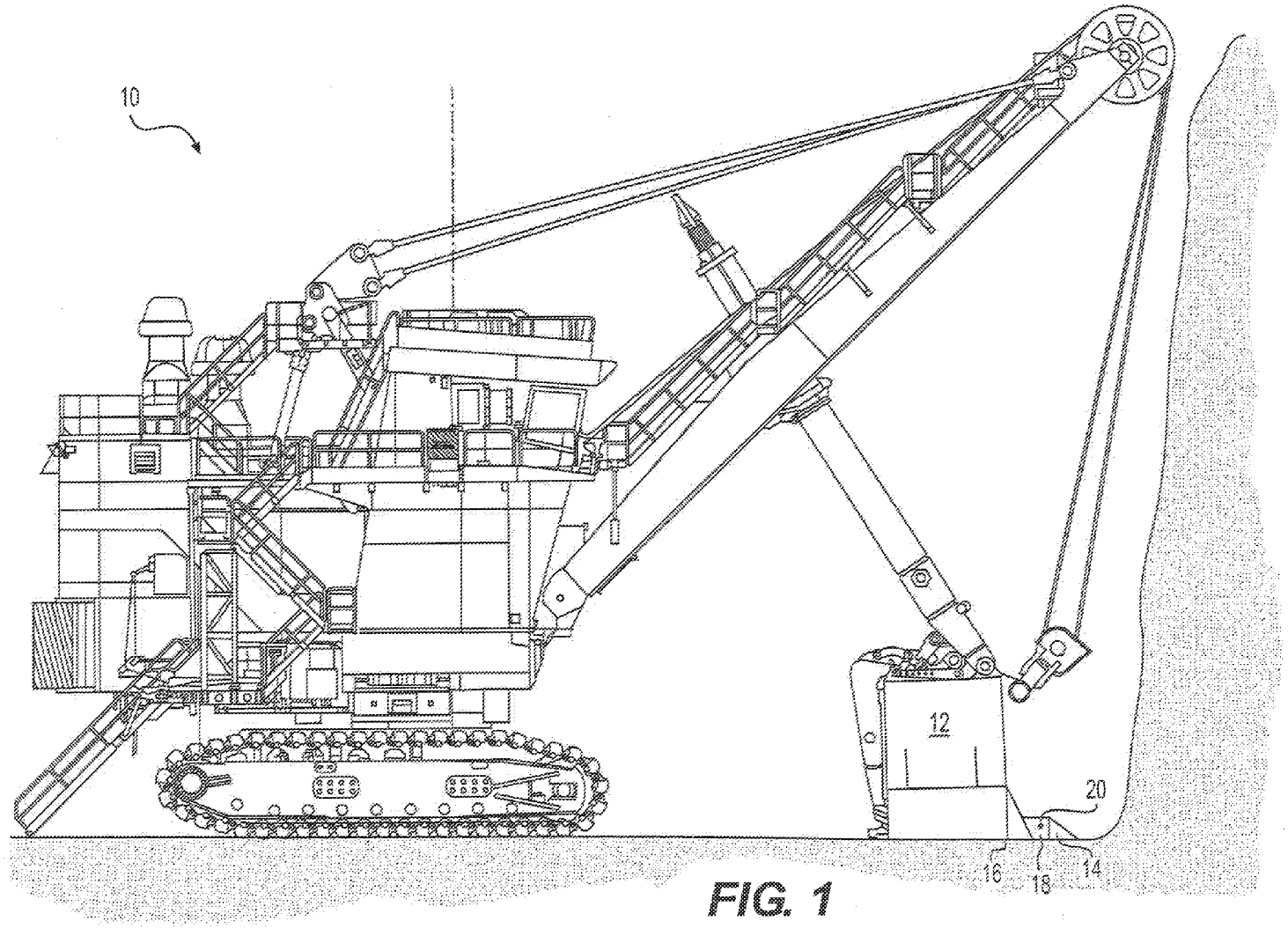
FIG. 1 is a side-view illustration of an exemplary disclosed machine.

FIG. 1 illustrates a machine 10 having a work implement 12 operatively connected at a leading end. In the disclosed embodiment, machine 10 is a rope shovel. It is contemplated, however, that machine 10 may embody any other type of mobile or stationary machine known in the art, for example a wheel loader, an excavator, a motor grader, a dredge, or another similar machine. Machine 10 may be configured to use work implement 12 to move material, such as earthen overburden and ore, during completion of an assigned task. Although shown as being located at the leading end of machine 10, it is contemplated that work implement 12 could alternatively or additionally be located at a midpoint or trailing end of machine 10, if desired.

Work implement 12 may embody any device used to perform a particular task. For example, work implement 12 could be a bucket (shown in FIG. 1), a blade, a shovel, a crusher, a grapple, a ripper, or any other material moving device known in the art. Although connected in the embodiment of FIG. 1 to lift, curl, and dump relative to machine 10, work implement 12 may alternatively or additionally rotate, swing, pivot, slide, extend, open/close, or move in another manner known in the art.

Work implement 12 may be equipped with one or more ground engaging tools (GET) 14 located at a cutting edge 16. For example, the disclosed bucket could be provided with multiple similar tooth assemblies that are spaced apart along a length of cutting edge 16. While shown as single-point, sharpened tooth assemblies, it is contemplated that GET 14 could take any other form known in the art, for example a fork (i.e., multi-point) configuration, a chisel configuration, or a blunt-end configuration.

GET 14 may be a conventional single- or multi-piece component that is removably connected to work implement 12. In the embodiment shown in FIG. 2, GET 14 is a single-piece component that is connected to a mounting nose 18 of work implement 12 at cutting edge 16 via a retention system 20. Mounting nose 18 may be joined to cutting edge 16 in any manner known in the art, for example via welding, threaded fastening, integral posts and clips, etc. Thereafter, retention system 20 may be used to removably connect GET 14 to work implement 12.

GET 14 and mounting nose 18 may both be generally hollow structural members, and a base end 22 of GET 14 may be configured to fit over mounting nose 18. A pair of aligned apertures 24 (only one shown in FIG. 2) may be formed at base end 22 of GET 14 within opposing side walls thereof, and a corresponding bore 26 may be formed within mounting nose 18. Apertures 24 may be generally aligned with bore 26 (shown in FIG. 3) when GET 14 is placed over mounting nose 18, so as to create aligned spaces that receive retention system 20.

Retention system 20 may include components that interact to clamp GET 14 in a removable manner to mounting nose 18. Specifically, retention system 20 may include, among other things, a pin 28 that is slidingly engaged with the aligned spaces of GET 14 and mounting nose 18, and fasteners 30 that are configured to engage opposing ends of pin 28. The engagement of fasteners 30 with pin 28, as will be described in more detail below, may cause the ends of pin 28 to deform and press against walls of bore 26 (shown in FIG. 3). This pressing action may function to lock GET 14 to mounting nose 18 and inhibit removal thereof.

Figure 2:
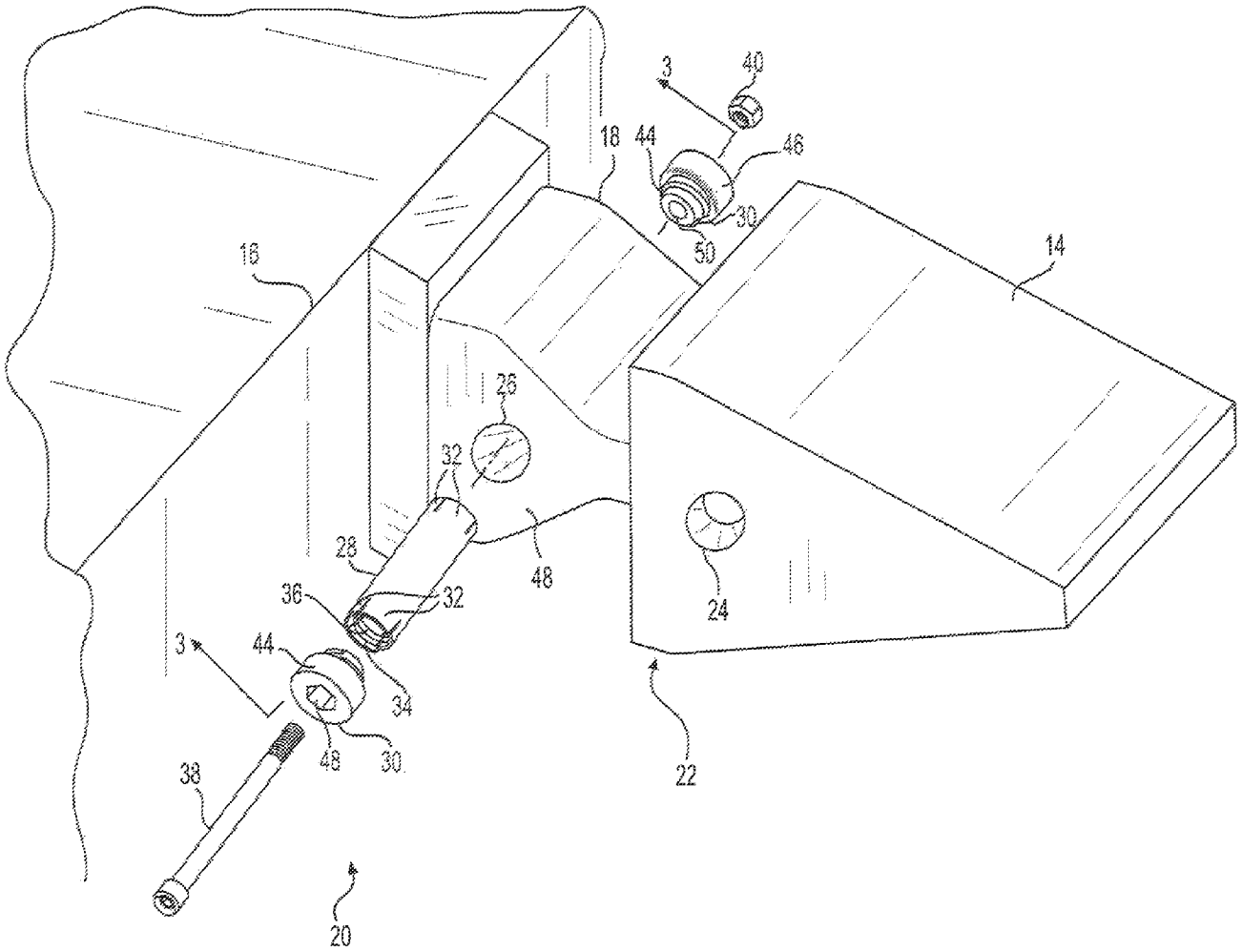
FIG. 2 is an exploded view illustration of an exemplary disclosed tool retention system that may be used in conjunction with the machine of FIG. 1.
Figure 3:
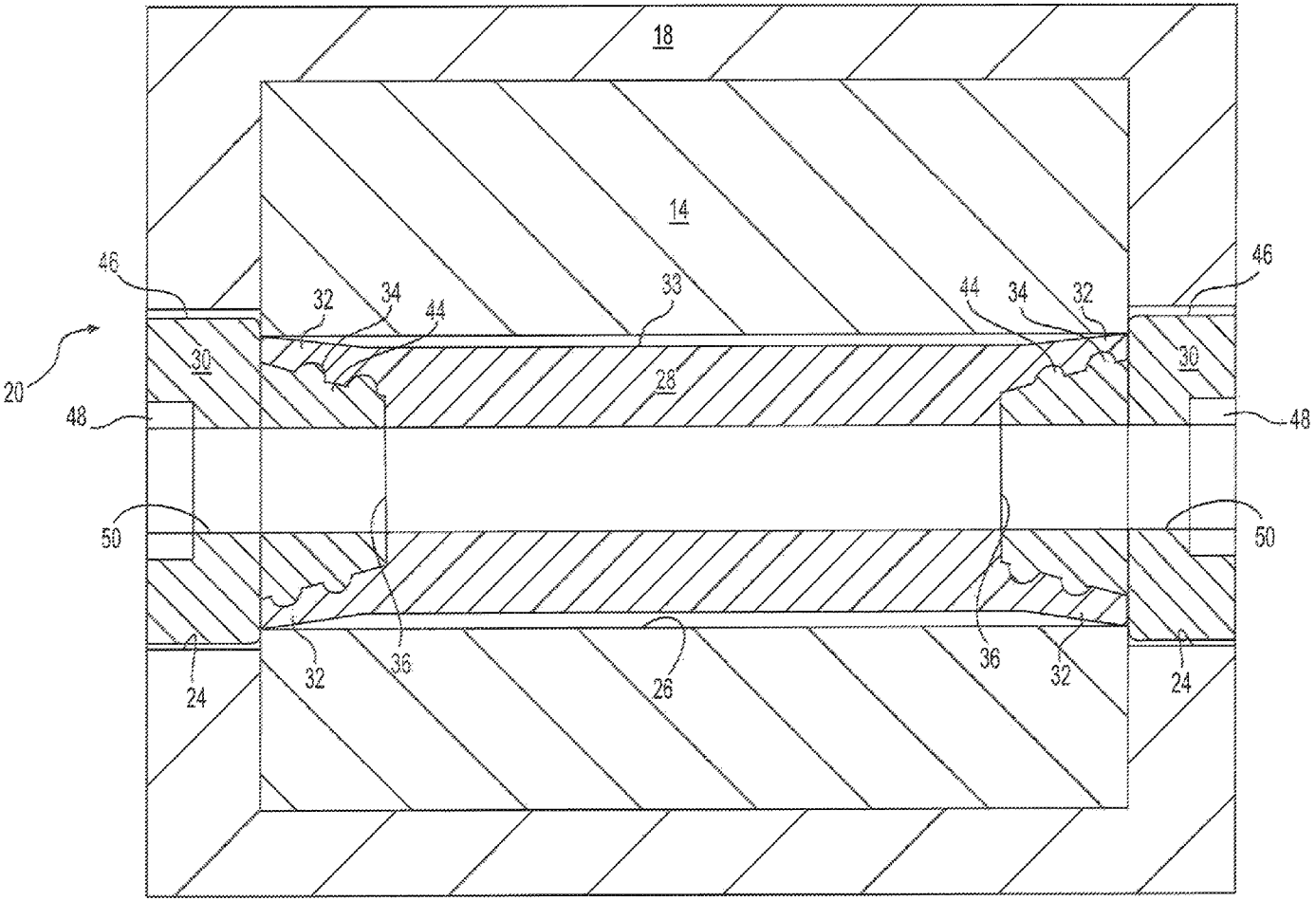
FIG. 3 is a cross-sectional view of the tool retention system of FIG. 2.

Pin 28 may be generally hollow, cylindrical, and include a plurality of axially extending fingers (fingers) 32 at both of its ends. In the disclosed embodiment, fingers 32 may be spaced substantially evenly around a circumference of pin 28, and include threads 34 at an internal surface. While the depicted embodiment of pin 28 is shown in FIG. 2 as having six fingers 32, it is contemplated that any number of fingers 32 may be utilized. As shown in FIG. 3, the threaded engagement of fasteners 30 with fingers 32 may force fingers 32 to flare radially outward and engage the walls of bore 26. A center portion of pin 28, however, may remain substantially cylindrical such that a clearance space 33 (shown only in FIG. 3) exists between an outer annular surface of the center portion and an inner annular wall of bore 26. In this manner, pin 28 may be removed from apertures 24 and bore 26 by forcing the already flared fingers 32 to slide through bore 26 after fasteners 30 have been removed.

An axial end-stop or seat 36 may be located at each end (only one end shown) of pin 28 that can be used to remove pin 28 from bore 26, in particular, a bolt 38 (referring to FIG. 2) may pass through pin 28 and include a head 40 that rests against seat 36. A nut 42 may be configured to engage a distal threaded end of bolt 38 and rest against the corresponding seat 36 at the opposing end of pin 28. During replacement of GET 14, a gear puller (not shown) or other similar tool may then be engaged with bolt 38 and/or nut 42, and used to force pin 28 (and flared fingers 32) through apertures 24 and bore 26 by pulling on bolt 38 and/or nut 42.

As shown in both of FIGS. 2 and 3, fasteners 30 may be generally tapered, having a frustoconical outer surface (surface) 44 at one end and an enlarged collar 46 at an opposing end. Surface 44 may be threaded to engage internal threads 34 of pin 28, and an external end of each fastener 30 may include a tool engagement feature (feature) 48. In the disclosed embodiment, feature 48 includes a recessed hexagonal socket configured to receive the tip of an Allen wrench. It is contemplated, however, that other tool engagement features may alternatively be used, for example a protruding hexagonal head, a Phillips screwdriver recess, a flat screwdriver slot, etc. When a corresponding tool is used to exert torque on fasteners 30, fasteners 30 may be rotated and driven further into the hollow ends of pin 28. As fasteners 30 are inserted deeper into pin 28, the frustoconical nature of surface 44 may push fingers 32 further outward and into greater engagement with the walls of bore 26. A hole 50 in each fastener 30 may allow for storage of bolt 38 and/or nut 42 during use of GET 14, if desired. During removal of GET 14, at least one of fasteners 30 may need to first be removed before engaging the gear puller with bolt 38 and/or nut 42.

Collar 46 of each fastener 30 may have a diameter selected to pass through apertures 24, yet engage the inner annular surfaces of apertures 24 to inhibit removal of GET 14. In particular, the radial flaring of axial fingers 32 may result in pressure being exerted on only the internal walls of bore 26. That is, in some embodiments, pin 28 may have an axial length that is the same as or less than an axial length of bore 26 and, thus, axial fingers 32 may not engage the walls of apertures 24. Instead, once fasteners 30 have engaged pin 28 to cause the flaring of fingers 32 that secures pin 28 in place, collars 46 may be positioned inside apertures 24. And this positioning of collars 46 may result in a mechanical interference that inhibits GET 14 from being removed from mounting nose 18.

INDUSTRIAL APPLICABILITY

The disclosed tool retention system may be applicable to various earth-working machines, such as cable shovels, wheel loaders, excavators, front shovels, dredges, and bulldozers. When used to removably connect ground engaging tools to the work implements of these machines, the ground engaging tools may be maintained in tight connection with the work implements throughout operation. Accordingly, the disclosed tool retention system may help to prolong the useful life of the implements and the machines, while also helping the operator to remain confident in the durability of the ground engaging tool.

Because the disclosed tool retention system comprises a reduced number of components, the system may be simple, robust, easy to use, and relatively inexpensive. In addition, because the system utilizes a pin that is radially symmetrical, the corresponding apertures and bore in the tool and implement may also be symmetrical. This relationship may allow for decreased machining cost and simplified assembly.

It will be apparent to those skilled in the art that various modifications and variations can be made to the disclosed retention systems. Other embodiments will be apparent to those skilled in the art from consideration of the specification and practice of the disclosed retention systems. For example, it may be possible for fasteners 30 to have a cylindrical inner end that is threaded and a conical outer end at collar 46 that is not threaded. In another example, one or more of fasteners 30 may be integral with pin 28. In yet another example, fasteners 30 may not have threading at all, and bolt 38 may instead be used to compress fasteners 30 towards each other and expand fingers 36. It is intended that the specification and examples be considered as exemplary only, with a true scope being indicated by the following claims and their equivalents.

What is claimed is:

1. A tool assembly, comprising:

a work implement having a protruding nose portion and a bore passing transversely through the protruding nose portion;

a replaceable tool configured to receive the protruding nose portion of the work implement and having apertures at opposing sides that are generally aligned with each other and with the bore of the work implement;

a pin extending through the apertures of the replaceable tool and the bore of the work implement, and having a plurality of axially extending fingers located at each of two opposing ends;

a first tapered fastener configured to engage the axially extending fingers at a first of the two opposing ends; and a second tapered fastener configured to engage the axially extending fingers at a second of the two opposing ends, wherein:

engagement of the first and second tapered fasteners with the axially extending fingers causes the axially extending fingers to flare radially outward and engage the work implement; and heads of the first and second tapered fasteners engage walls of the apertures in the replaceable tool.

2. The tool assembly of claim 1, wherein a center of the pin is generally cylindrical after the axially extending fingers flare radially outward.

3. The tool assembly of claim 2, wherein:

a clearance space is maintained between the center of the pin and the work implement; and the axially extending fingers are pressed against walls of only the work implement after the axially extending fingers flare radially outward.

* * * * *